US006049684A

United States Patent [19]

Nishikawa et al.

[11] Patent Number: 6,049,684

[45] Date of Patent: Apr. 11, 2000

[54] IMAGE FORMATION APPARATUS

[75] Inventors: Hiroshi Nishikawa; Kazunori Shindo; Toshiya Kusayanagi, all of Niigata, Japan

[73] Assignee: NEC Corporation, Japan

[21] Appl. No.: 09/246,434

[22] Filed: Feb. 8, 1999

[30] Foreign Application Priority Data

| | | | |
|---|---|---|---|
| Feb. 17, 1998 | [JP] | Japan | 10-035047 |
| Feb. 18, 1998 | [JP] | Japan | 10-035760 |
| Feb. 27, 1998 | [JP] | Japan | 10-047382 |

[51] Int. Cl.[7] ..... G03G 15/10

[52] U.S. Cl. ..... 399/249; 399/233; 399/237

[58] Field of Search ..... 399/237, 239, 399/249, 233

[56] References Cited

U.S. PATENT DOCUMENTS

| | | | |
|---|---|---|---|
| 3,874,328 | 4/1975 | Isonaka et al. | 399/249 X |
| 5,300,990 | 4/1994 | Thompson | 399/249 X |
| 5,384,225 | 1/1995 | Kurotori et al. | 399/237 X |
| 5,521,685 | 5/1996 | Barnes et al. | 399/249 |
| 5,576,815 | 11/1996 | Teschendorf et al. | 399/249 |
| 5,913,096 | 6/1999 | Park | 399/237 |

FOREIGN PATENT DOCUMENTS

| | | |
|---|---|---|
| 49-91461 | 8/1974 | Japan . |
| 51-24294 | 6/1976 | Japan . |
| 56-75678 | 6/1981 | Japan . |
| 58-18666 | 2/1983 | Japan . |
| 58-37540 | 8/1983 | Japan . |
| 62-59983 | 3/1987 | Japan . |
| 62-55667 | 11/1987 | Japan . |
| 62-61151 | 12/1987 | Japan . |
| 63-178278 | 7/1988 | Japan . |
| 3-1686783 | 7/1991 | Japan . |
| 4-156489 | 5/1992 | Japan . |
| 4-350878 | 12/1992 | Japan . |
| 5-216290 | 8/1993 | Japan . |
| 5-273867 | 10/1993 | Japan . |
| 6-19267 | 1/1994 | Japan . |
| 7-175331 | 7/1995 | Japan . |
| 7-199668 | 8/1995 | Japan . |
| 7-301997 | 11/1995 | Japan . |
| 8-36312 | 2/1996 | Japan . |
| 8-123207 | 5/1996 | Japan . |

*Primary Examiner*—Susan S. Y. Lee

*Attorney, Agent, or Firm*—Ostrolenk, Faber, Gerb & Soffen, LLP

[57] ABSTRACT

An image formation apparatus for performing development by supplying to a photosensitive body a developing solution containing toner includes a developing roller; a developing solution supply port; a squeeze roller for wiping off an unnecessary portion of the developing solution from the photosensitive body; a moving frame reciprocally moving toward/from the photosensitive body; a squeeze support body for holding the squeeze roller; and two elastic bodies having different natural lengths that are provided between the moving frame and the squeeze support body and can be expanded and contracted for urging depression of the squeeze roller toward the photosensitive body.

18 Claims, 10 Drawing Sheets

IMAGE FORMATION APPARATUS

BACKGROUND OF THE INVENTION

1. Field of the Invention

The present invention relates to an image formation apparatus and in particular, to an electron-photographic image formation apparatus using a liquid developing agent.

2. Description of the Related Art

In a conventional image formation apparatus performing development by supplying a developing liquid containing toner to a photosensitive body, development is performed by a developing solution supplied from a developer supply inlet into a clearance between a development roller and a belt-shaped photosensitive body. In this development, an necessary developing solution adhered to the belt-shaped photosensitive body is wiped away by a squeeze roller. The squeeze roller is rotatably supported by a squeeze support body which is mounted via a compression coil spring on a moving frame that can vertically move toward and away from the film-shaped photosensitive body. When the moving frame comes nearer to the film-shaped photosensitive body, the squeeze roller is pushed to into abutment with the film-shaped photosensitive body with a greater depression force of the elasticity of the compression coil spring, and when the moving frame goes apart from the film-shaped photosensitive body in a reach of the compression coil spring, the squeeze roller is in abutment with the film-shaped photosensitive body with a smaller depression force of the compression coil spring.

Normally, the moving frame is in the proximity of the belt-shaped photosensitive body, so that the squeeze roller is pushed against the belt-shaped photosensitive body with a strong force of the compression coil spring and is rotated in the same direction as the moving direction of the surface of the belt-shaped photosensitive body. This rotation performs the squeezing, i.e., wipe off of the unnecessary developing solution. As a result, the image on the belt-shaped photosensitive body is film-shaped, which is then subjected to a drying process before transferred onto a paper.

In this squeeze operation, the unnecessary developing solution squeezed from the belt-shaped photosensitive body by the squeeze roller remains at the upstream side to the contact portion between the belt-shaped photosensitive body and the squeeze roller. If the apparatus is stopped in this state, the remaining developing solution is dried into a solid state, which is sure to cause stains on the next printing.

For this, in this type of image formation apparatus, as disclosed in Japanese Patent Publication (unexamined) 5-273867, the squeeze roller is maintained at a certain distance from the photosensitive body and rotated in the opposite direction so as to remove an unnecessary portion of the developing solution without distorting the toner image being developed. More specifically, immediately before stopping operation of the image formation apparatus, the moving frame holding the squeeze support bodies at the both sides of the squeeze roller is moved away from the belt-shaped photosensitive body to expand the compression coil spring, thus reducing the pressing force of the squeeze roller to the belt-shaped photosensitive body. This enables the squeeze roller to rotate in the opposite direction to the movement direction of surface of the belt-shaped photosensitive body. Thus, by rotating the squeeze roller in the opposite direction, it is possible to effectively remove the remaining developing solution from the belt-shaped photosensitive body.

Moreover, Japanese Patent Publication (unexamined) 58-18666 discloses an invention for wiping down the remaining developing solution by using a blade from the surface of the squeeze roller. This is because if the developing solution remains on the squeeze roller, it is inconvenient for removing an unnecessary portion of the developing solution from the belt-shaped photosensitive body.

However, the conventional image formation apparatuses have various problems.

Firstly, in the conventional image formation apparatus, a single compression coil spring provided in the squeeze support bodies at both ends of the squeeze roller was the only means for changing the force pushing the squeeze roller to the belt-shaped photosensitive body so as to switch between the follower rotation (during a printing) and the opposite-direction rotation (during a cleaning).

However, the optimal pushing force of the squeeze roller for the opposite-direction rotation of the squeeze roller is as small as 1/10 of the optimal pushing force for the follower rotation. Moreover, the compression coil spring should have a short free length for reducing the size of the image formation apparatus. With such single compression coil spring having a short free length, it has been difficult to obtain optimal pushing forces for the follower rotation and the driven rotation.

That is, when it is possible to obtain an optimal pushing force for the follower rotation or the driven rotation, it is impossible to obtain an optimal pushing force for the other rotation. If an optimal pushing force cannot be obtained for the follower rotation (during a printing), an image on the belt-shaped photosensitive body after squeezing cannot be made into a film shape, causing a transfer failure or deterioration of the image. If an optimal pushing force cannot be obtained for the driven rotation (during a cleaning), the developing solution remaining between the squeeze roller and the belt-shaped photosensitive body cannot be removed completely or the belt-shaped photosensitive body may be scratched.

Moreover, as a second problem, in a conventional color image formation apparatus, it is necessary to provide four developers for the three primary colors of Yellow, Magenta, Cyan, and Black, which makes it difficult to reduce the size and weight of the image formation apparatus.

For example, the image formation apparatus requires a frame having a high rigidness for supporting a large load as well as a large-size motor for driving the apparatus. This also increases the production cost of the image formation apparatus.

Furthermore, as a third problem, if the squeeze roller having a liquid developing agent adhered thereto is left as it is for a long period of time, the developing solution on the squeeze roller is dried and toner is adhered to the roller surface, deteriorating its performance, causing an image by black stripes.

Even when the blade is brought into abutment with the squeeze roller, it has been difficult actually to completely remove the developing agent adhered to the squeeze roller. If the remaining developing agent is dried, it cannot be removed by the blade.

Thus, in the conventional image formation apparatus, the squeeze roller cannot have a service life as long as the service life of other components including the developing roller. It has been necessary to periodically clean the apparatus by a user or a maintenance staff.

SUMMARY OF THE INVENTION

It is therefore an object of the present invention to provide an image formation apparatus enabling to effectively perform the squeeze and cleaning with respect to the photosensitive body as well as to improve the printing environment.

Another object of the present invention is to provide an image formation apparatus having a reduced load.

Yet another object of the present invention is to provide an image formation apparatus capable of maintaining a high image quality for a long period of time.

The image formation apparatus according to the present invention is for performing development by supplying to a photosensitive body a developing solution containing toner, the apparatus comprising: a developing roller for carrying the developing solution to the photosensitive body; a developing solution supply port for supplying the developing solution to the developing roller; a squeeze roller for wiping of an unnecessary portion of the developing solution from the photosensitive body; rotation urging means for urging rotary operation of the squeeze roller; a moving frame reciprocally moving toward/from the photosensitive body; a moving frame urging mechanism for urging movement of the moving frame; a squeeze support body for holding the squeeze roller, the support body being mounted on the moving frame in such a manner that the support body can move toward/from the photosensitive body; and two elastic bodies having different natural lengths that are provided between the moving frame and the squeeze support body and can be expanded and contracted for urging depression of the squeeze roller toward the photosensitive body.

In the image formation apparatus having the aforementioned configuration, during a printing operation, the moving frame is urged by the moving frame urging mechanism to approach the photosensitive body and the squeeze support body provided between the moving frame and the photosensitive body relatively approaches the moving frame, so that the squeeze roller is brought into contact with the photosensitive body and the two longer and shorter elastic bodies are compressed between the squeeze support body and the moving frame. Accordingly, the squeeze roller is brought into contact with the photosensitive body with a strong depression force from the elastic force of the elastic bodies.

In this state, the squeeze roller follows the movement of the driven photosensitive body. At the upstream side of the photosensitive body, the developing roller performs development of the sensitive body and an excessive developing solution is squeezed. After that, a toner image on the photosensitive body is dried and printed onto a paper.

On the other hand, when the development is complete, the moving frame departs from the photosensitive body and is set at a certain distance. This distance corresponds to a distance between the squeeze support body and the moving frame, which distance allows the shorter elastic body is prolonged than its natural length and only the longer elastic body urges a depression force to the squeeze roller. Thus, the depression force of the squeeze roller to the photosensitive body is obtained only from the longer elastic body. That is, the depression force is sufficiently small. The squeeze roller is rotated by the rotation urging means in the opposite direction to the drive direction of the photosensitive body. That is, the squeeze roller is rotated to slide against the drive direction of the photosensitive body, thus removing the remaining developing solution from the photosensitive body.

When the cleaning is complete, the moving frame is further carried further away from the photosensitive body so that the squeeze roller is completely apart from the photosensitive body.

Here, the aforementioned elastic bodies may be compression coil springs having different natural lengths provided along the movement direction of the squeeze support body. It is preferable that the longer compression coil spring have a spring constant smaller than that of the shorter compression coil spring. Especially preferable is to set the coil constants so that the depression force of the squeeze roller to the photosensitive body obtained by the longer compression coil spring alone and the depression force of the squeeze roller to the photosensitive body obtained by simultaneous use of the two compression coil springs are in a ratio of about 1:10.

Moreover, the aforementioned developing roller may be mounted on the moving frame in the same way as the squeeze roller. Here, the developing roller is arranged on the moving frame at a position to be in contact with the photosensitive body when the squeeze roller is depressed to the photosensitive body with a large depression force obtained by the elastic forces of the two elastic bodies. Accordingly, during a cleaning by the squeeze roller, the developing roller is apart from the photosensitive body.

Furthermore, it is possible to provide a cleaning mechanism for each of the developing roller and the squeeze roller so that their surfaces are cleaned.

Moreover, it is possible to provide a second squeeze roller on the squeeze support body at the downstream side of the squeeze roller, so as to wipe of an excess developing solution remaining outside of the two ends of the squeeze roller in the rotary shaft direction.

According to another aspect of the present invention, the image formation apparatus is a color image formation apparatus comprises a Yellow developer, a Magenta developer, a Cyan developer, and a Black developer for successively forming a Yellow image, a Magenta image, a Cyan image, and a Black image in a predetermined order on a circulating belt-shaped photosensitive body, each of the developers including: a developing roller for supplying an ink to a latent image formed on the belt-shaped photosensitive body by a corresponding laser device; a developing solution supply port for supplying the ink to the developing roller; a squeeze roller provided at the downstream side of the developing roller so as to remove the ink adhered to a portion other than the latent image on the belt-shaped photosensitive body and to dry the developed image into a film state; a backup roller provided so as to sandwich the belt-shaped photosensitive body by incorporating with the squeeze roller; a spring for depressing the squeeze roller to the backup roller; and a cleaning roller for cleaning the developing roller, wherein four of the springs have different depression forces in the ascending order from a first to a fourth developer.

It is preferable that the spring in the first developer be set to 3 to 9 kgf; the spring in the second developer be set to 6 to 12 kgf; the spring in the third developer be set to 9 to 15 kgf; and the spring in the fourth developer be set to 12 to 18 kgf.

The first developer is a Yellow developer, the second developer is a Magenta developer, the third developer is a Cyan developer, and the fourth developer is a Black developer. Alternatively, the first developer is a Magenta developer, the second developer is a Yellow developer, the third developer is a Cyan developer, and the fourth developer is a Black developer. Alternatively, the first developer is a Cyan developer, the second developer is a Magenta developer, the third developer is a Yellow developer, and the fourth developer is a Black developer. Moreover, the squeeze roller is made from an elastic resin material such as urethane.

According to yet another aspect of the present invention, the image formation apparatus comprises: a photosensitive body having a surface on which an electrostatic latent image is formed; a developing roller provided in the vicinity of the photosensitive body, for supplying a developing solution onto a surface of the photosensitive body; a squeeze roller arranged at the downstream side of the developing roller so as to be in contact with the photosensitive body; and a cleaning roller arranged in the vicinity of the squeeze roller so as to be in contact with a surface of the squeeze roller.

In the aforementioned configuration, the cleaning roller cleans both of the developing roller and the squeeze roller. The cleaning roller can remove a solidified portion of the developing solution from surfaces of the developing roller and the squeeze roller. The cleaning roller is in contact with the squeeze roller only for a predetermined period of time after completion of a printing procedure.

DESCRIPTION OF THE PREFERRED EMBODIMENTS

Figure 1:
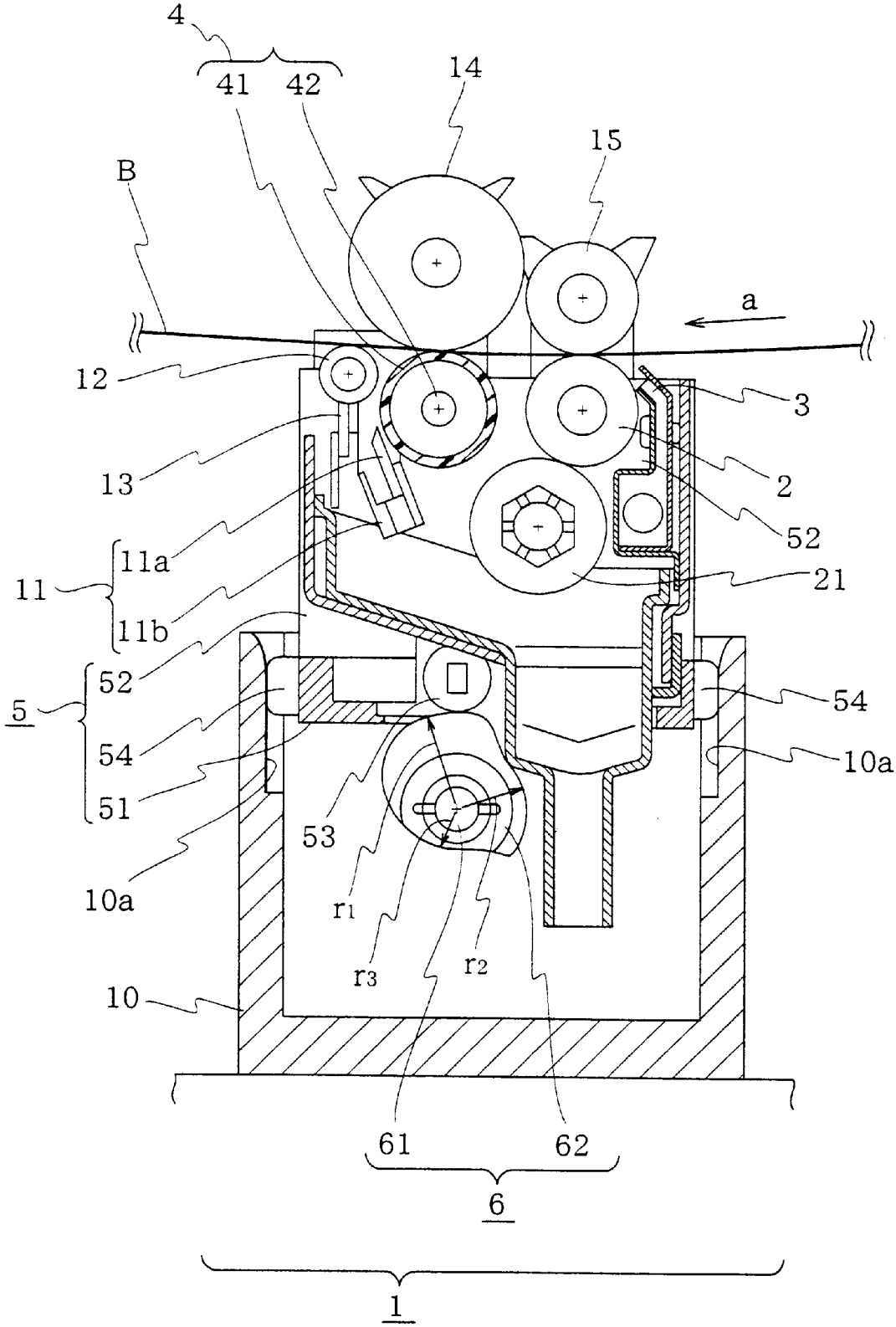
FIG. 1 is a cross sectional view of an image formation apparatus according to a first embodiment of the present invention.

Hereinafter, description will be directed to embodiments of the present invention with reference to the attached drawings.

Firstly, explanation will be given on the first embodiment of the present invention with reference to FIG. 1 to FIG. 4. The first embodiment is a wet-type image formation apparatus 1 in which a developing solution containing toner is supplied to a belt-shaped photosensitive body B for development. The wet-type image formation apparatus 1 is provided inside a printing apparatus (not depicted).

This image formation apparatus includes: a developing roller 2 for developing the belt-shaped photosensitive body with a developing solution; a developing solution supply port 3 for supplying the developing solution to the developing roller; a squeeze roller 4 for wiping off any unnecessary portion of the developing solution from the belt-shaped photosensitive body B; rotation urging means (not depicted) for rotating the squeeze roller 4; a moving frame 5 reciprocally moving toward and from the belt-shaped photosensitive body B; a cam mechanism 6 for urging the movement of this moving frame 5; and a squeeze support body 7 (FIG. 2) provided on the moving frame 5 for supporting the squeeze roller 4 in such a manner that the squeeze support body 7 can move in the direction approaching toward and departing from the belt-shaped photosensitive body B. Moreover, two compression springs 8 and 9 having different free lengths are inserted between the moving frame 5 and the squeeze support body 7, so as to urge the squeeze roller 4 toward the belt-shaped photosensitive body B.

The respective components will be detailed below. It should be noted that the belt-shaped photosensitive body B is fed by a drive apparatus (not depicted) in a direction of arrow "a" in FIG. 1.

The image formation apparatus 1 further includes a base 10 fixed inside a printing apparatus at a constant distance from the belt-shaped photosensitive body B. This base is box-shaped having an opening toward the belt-shaped photosensitive body B. The aforementioned moving frame 5 vertically moves with respect to this base 10 along two guide grooves 10*a* provided at the top of inner surfaces of the base 10.

Figure 2:
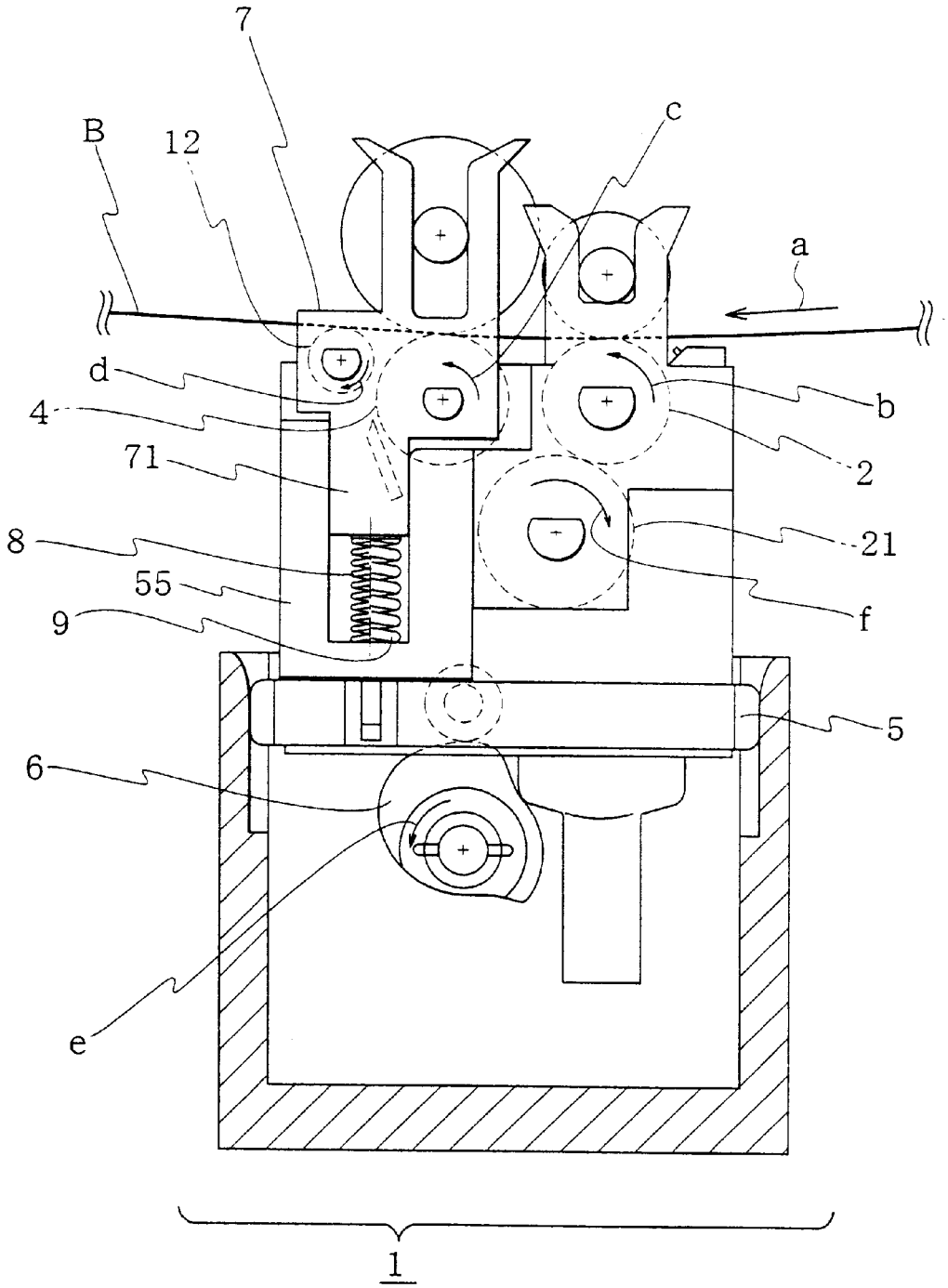
FIG. 2 shows the image formation apparatus according to the first embodiment in a printing operation state.

The moving frame 5 has a bottom plate 51 and two side walls 52, 52 (one of which is omitted in the figure) extending from the bottom plate 51 so as to face each other. As shown in FIG. 1 and FIG. 2, the aforementioned developing roller 2 is arranged between the two side walls 52, 52. On the other hand, the bottom plate 51 has at its both ends, engagement protrusions 54, 54 which are engaged with the guide grooves 10*a*, 10*a* of the aforementioned base 10. Moreover, the cam mechanism 6 is arranged below the bottom plate 51, and an abutment member 53 is provided in the vicinity of the bottom plate 51 for abutment with the cam plate 62 of the cam mechanism 6.

The cam mechanism 6 is arranged on the inner surface of the base 10 below the moving frame 5. This cam mechanism includes: a rotary shaft 61 rotatably mounted on the base 10, a cam plate 62 rotating together with the rotary shaft 61; and a drive motor (not depicted) for rotating the rotary shaft 61. As shown in FIG. 1, the cam plate 62 is divided into three regions having a radius of r1, r2, r3 (r1>r2>r3) from the rotation center, so that the rotation of the cam mechanism 6 enables the switching of distances between the rotary shaft 61 and the abutment member 53. This enables the moving frame 5 to be set in three stages of distance to the belt-shaped photosensitive body B. That is, at the radius r1, the moving frame 5 is set at the proximity of the belt-shaped photosensitive body B for performing squeeze; at the radius r2, the moving frame 5 is set slightly apart from the belt-shaped photosensitive body B for performing cleaning; and at the radius r3, the moving frame 5 is set at the farthest position from the belt-shaped photosensitive body B, for feeding the belt-shaped photosensitive body which has been developed.

The developing roller 2 is a cylindrical metal member having two ends rotatably supported by the two side walls 52, 52 of the moving frame 5. During a development operation (when the moving frame 5 is at the uppermost position), the developing roller 2 is set at a position to define a fine clearance (about 150 micrometers) with respect to the belt-shaped photosensitive body B, and driven to rotate in a direction of arrow "b" in FIG. 2 so as to feed into this clearance the developing solution supplied from the developing solution supply port 3 for developing an electrostatic latent image formed on the belt-shaped photosensitive body B. After the development operation is complete, immediately before the apparatus stops, the developing roller 2 is moved together with the moving frame 5 apart from the belt-shaped photosensitive body B (see FIG. 3).

This developing roller 2 is cleaned by the cleaning roller 21 having two ends rotatably supported by the two side walls 52, 52 of the moving frame 5. The cleaning roller 21 is a cylindrical member having an almost identical length as the developing roller 2 and consisting of a roller member made from a sponge-like material (Scotch Bright (trade name) produced by 3M Co. Ltd.) and a shaft member which is a hollow metal member.

This shaft member has a configuration as follows. The portion surrounded by the roller member has a hexagonal cross section and each side has a number of fine holes. When the developing solution is supplied to this hollow shaft member, the developing solution is supplied to the sponge-line roller member through the holes.

This cleaning roller 21 is brought into abutment with the outer circumference of the developing roller 2 with a predetermined depression force and during a development operation, rotated in a direction of arrow "f" in FIG. 2 so that the developing solution oozing out from the sponge-like roller member cleans the developing solution remaining on the developing roller 2 without being developed.

Next, explanation will be given on the squeeze roller 4. The squeeze roller 4 is a cylindrical member having an almost identical length as the developing roller 2 and consisting of a roller member 41 made from urethane rubber and a shaft member 42 which is a hollow metal member having two ends rotatably supported by the squeeze support body 7 (see FIG. 2).

A washing mechanism 11 is mounted on the squeeze support body 7 so as to be arranged in the proximity of the outer circumference of the squeeze roller 4 for washing the outer circumference of the squeeze roller 4. This washing mechanism 11 includes: a wiper blade 11*a* facing the outer circumference of the squeeze roller 4 and having a length almost identical to the width of the squeeze roller 4 in the shaft direction; and a moving mechanism 11*b* having a solenoid, for example, for moving the edge of the wiper blade 11*a* toward and apart from the squeeze roller 4. The moving mechanism 11*b* is linked to the cam mechanism 6. When the cam plate 62 is brought into contact with the abutment member 53 with the radius r2 (during a cleaning of the belt-shaped photosensitive body B), the wiper blade 11*a* is pressed to the squeeze roller 4 so as to scratch off the developing solution.

On the squeeze support body 7, at the downstream side of the squeeze roller, there is provided a second squeeze roller for wiping off the remaining developing solution at the both ends of the squeeze roller in the rotation axis direction. This second squeeze roller 12 includes two roller portions (only one of them is depicted) at positions corresponding to the two ends of the squeeze roller so as to remove the developing solution left at the two ends on the belt-shaped photosensitive body after cleaning by the squeeze roller 4. This second squeeze roller 12, like the squeeze roller 4, has a roller portion made from urethane rubber and a shaft portion made from a hollow metal member and is rotatably supported on the squeeze roller support body 7. The second squeeze roller 12 can effectively remove the remaining developing solution from the belt-shaped photosensitive body.

This second squeeze roller 12 has a second wiper blade 13 pressed against the roller portions all the time. During a cleaning operation, the second wiper blade 13 scratches off the developing solution from the second squeeze roller 12.

Next, explanation will be given on the squeeze support body 7 with reference to FIG. 2. The squeeze support body 7 has a protrusion 71 that is engaged with a receiving member 55 fixed to the moving frame 5 and held in such a manner that it can move along the protrusion direction of the protrusion 71 (in the direction of approaching to and departing from the belt-shaped photosensitive body B).

Between the protrusion 71 of the squeeze support body 7 and the receiving member 55, there is provided a first pair of different compression coil springs 8, 9 that can expand and shrink to approach to and depart from the belt-shaped photosensitive body B. (In FIG. 2 to FIG. 4, an upper half of these compression coil springs 8, 9 is not depicted.) Another pair of these compression coil springs 8, 9 is provided as a second pair at the other end of the rotary shaft of the squeeze roller 4, though not depicted.

The compression coil spring 9 has one end fixed to the receiving member 55 and the other end left free. When the distance between the receiving member 55 and the squeeze support body 7 becomes greater than a natural length of the compression coil spring 9, the other end of the compression spring 9 is departed from the squeeze support body 7 and does not apply any external force (see FIG. 3.)

The compression coil spring 8 has a longer natural length than the compression coil spring 9 a spring constant set smaller than the compression coil spring 9. When the cam plate 62 of the cam mechanism 6 is brought into abutment with the abutment member 53 with the radius r1 (when the squeeze support body 7 is at the nearest position to the receiving member 55), the compression coil springs 8 and 9 are both compressed. When the cam plate 62 is in abutment with the abutment member 53 at the radius r2 (when the squeeze support body 7 is slightly apart from the receiving member 55), only the compression coil spring 8 is compressed and the compression coil spring 9 is apart from the squeeze support body 7.

Furthermore, the spring constants of the compression coil springs 8 and 9 are set so as to obtain a 1:10 ratio of the depression forces of the belt-shaped photosensitive body B by the squeeze roller when pushed by the compression coil spring 8 alone and when pushed by the compression coil springs 8 and 9. The spring constants are calculated by the natural lengths of the respective compression coil springs 8 and 9, the weight of the squeeze support body 7 when holding the squeeze roller 4 and the second squeeze roller 12, the friction caused when the squeeze support body 7 is moved, the number of pairs of the compression coil springs 8 and 9, the radius r1, r2, r3 of the cam plate 62, and the contraction amount of the compression coil spring 8 at the radius r3 of the cam plate 62.

In FIG. 1, the reference symbol 15 denotes an auxiliary roller facing the developing roller 2 and arranged so as to sandwich the belt-shaped photosensitive body B. The reference symbol 14 denotes an auxiliary roller facing the squeeze roller and arranged so as to sandwich the belt-shape photosensitive body B. Each of these auxiliary rollers 14, 15 is rotatably held by an arm (not depicted) extending from the base 10 in such a manner that a constant height is maintained regardless of the vertical motion of the moving frame 5. These auxiliary roller 14 and 15 follow the movement of the belt-shaped photosensitive body B.

Figure 3:
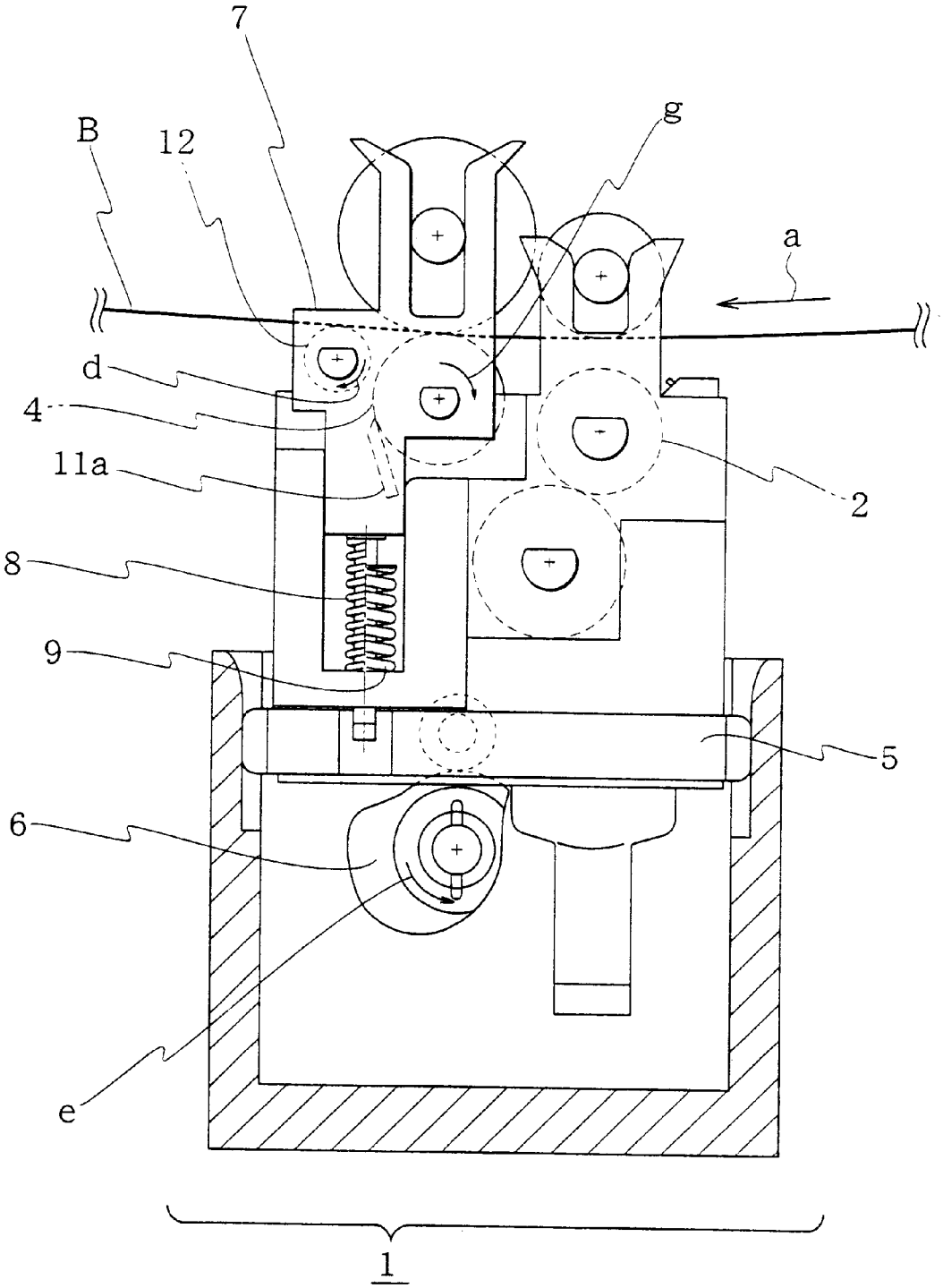
FIG. 3 shows the image formation apparatus according to the first embodiment in a cleaning operation state.
Figure 4:
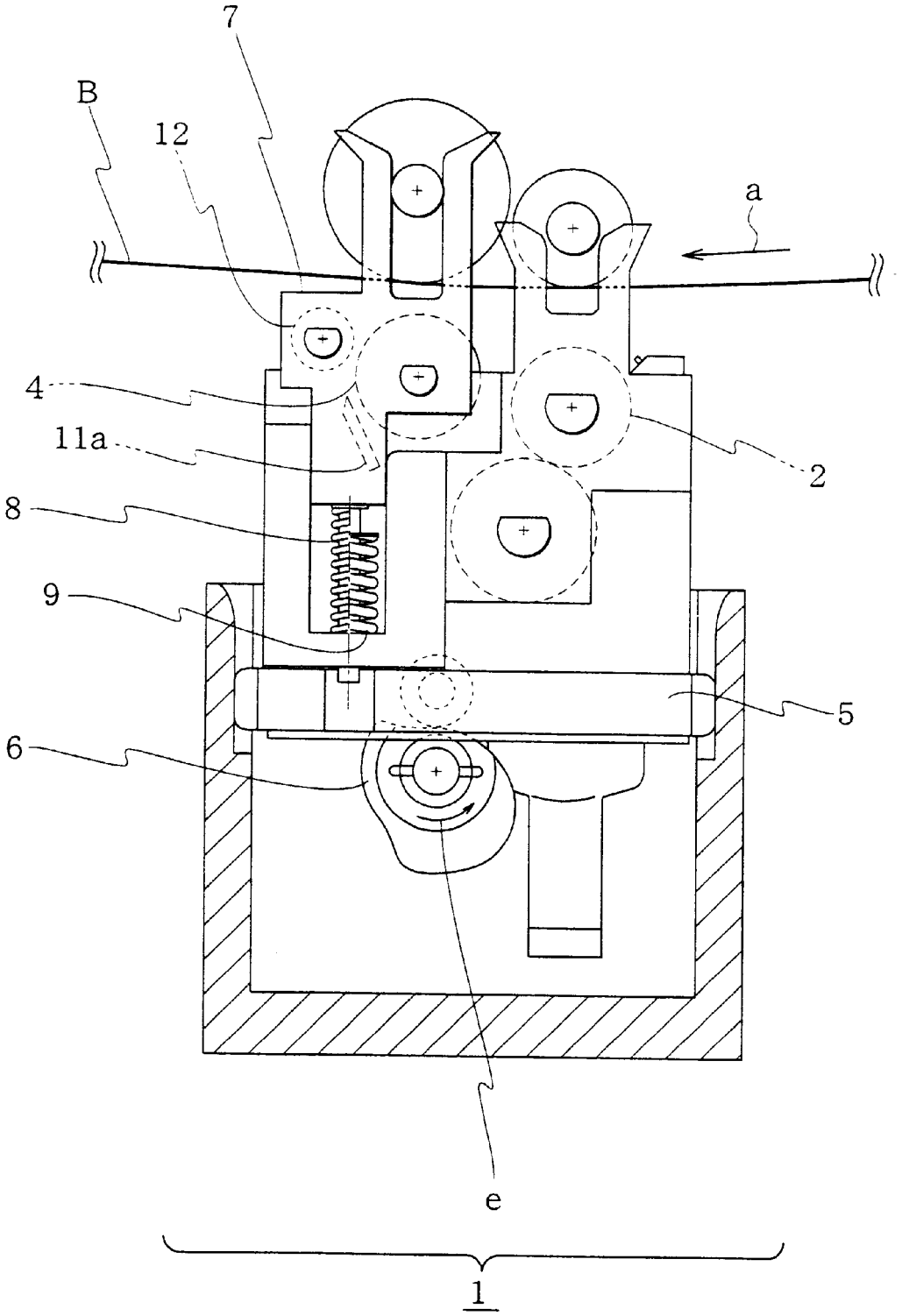
FIG. 4 shows the image formation apparatus according to the first embodiment in a stop operation state.

Description will now be directed to operation of the first embodiment with reference to FIG. 2 to FIG. 4.

Firstly, when a print data is supplied, the belt-shaped photosensitive body B starts to move in the direction of arrow "a" in the figure and plus-charged by a scorotron charger. After this, a developing solution circulation pump (not depicted) starts to operate for supplying a charged developing solution from the developing solution supply port 3 to the developing roller 2. Simultaneously with this, the cam mechanism 6 is rotated in the direction of arrow "e" in the figure to raise the moving frame 5 from the lower stage (stop position) to the upper stage (print position).

That is, as shown in FIG. 2, the radius r1 region of the cam plate 62 is in abutment with the abutment member 53 to raise the moving frame 5 to its upper most position (nearest to the belt-shaped photosensitive body B). In this state, the squeeze roller 4 is brought into abutment with the belt-shaped photosensitive body B. Accordingly, the clearance between the squeeze support body 7 and the moving frame 5 becomes smaller than the natural length of the shorter compression coil spring 9. Thus, the squeeze roller 4 is pushed to the belt-shaped photosensitive body B with both of the compression coil springs 8 and 9 compressed.

When this moving frame 5 is raised to the upper stage (print position), the developing roller 2 is arranged at a position maintaining the clearance of 150 micrometers with respect to the belt-shaped photosensitive body B, and the squeeze roller 4 is pushed to the belt-shaped photosensitive body B with the 12 kgf force by the compression coil springs 8, 9 provided between the squeeze roller support body 7 and the receiving member 55.

A laser unit (not depicted) performs an exposure procedure to form an electrostatic latent image on the belt-shaped photosensitive body B.

As the developing roller 2 rotates in the direction of arrow "b" in FIG. 2, the developing solution supplied from the developing solution supply port 3 is fed to the clearance between the belt-shaped photosensitive body B and the developing roller 2, thus developing the electrostatic latent image on the belt-shaped photosensitive body B coming into this clearance.

Here, a certain portion of the developing solution remaining undeveloped on the outer circumference of the developing roller 2 is cleaned off by the cleaning roller 21 from which another portion of developing solution is oozing out. Thus, it is possible to eliminate an adverse effect to the following development operation.

An unnecessary portion of the developing solution is adhered to the image on the belt-shaped photosensitive body B immediately after the development. This unnecessary developing solution is squeezed by the squeeze roller 4 which is pushed to the belt-shaped photosensitive body B with the 12 kgf force. This makes the image on the belt-shaped photosensitive body B into a film-shaped image.

After this, the film-shaped image is fed to a drying unit (not depicted) to be dried and then to a transfer unit so as to be transferred onto a paper.

Here, the second squeeze roller 12 is driven to rotate in the direction of "d" in FIG. 2 thereby to remove the developing solution left by the squeeze roller 4 outside its width on the belt-shaped photosensitive body B. The remaining developing solution is scratched off by the second wiper blade 13 (see FIG. 1) which is in abutment with the outer circumference of the second squeeze roller 12.

When the printing operation is complete, the developing solution circulation pump stops and the cam mechanism is again rotated in the direction of "e" in the figure so that the moving frame 5 is lowered from the upper stage (printing position) to an intermediate stage.

That is, as shown in FIG. 3, the r2 region of the cam plate 62 is in abutment with the abutment member 53 and the moving frame 5 is set slightly apart from the belt-shaped photosensitive body B. This makes the clearance between the squeeze support body 7 and the moving frame 5 smaller than the natural length of the longer compression coil spring 8 and greater than the natural length of the shorter compression coil spring 9. Accordingly, the elastic force of the compression coil spring 9 is not applied to the squeeze support body 7, and only the compression coil spring 8 operates to push the squeeze roller 4 to the belt-shaped photosensitive body B with a 1.2 kgf force.

Here, the squeeze roller 4 is driven to rotate in the direction of arrow "g" (opposite to "c") thereby to remove the developing solution left after the printing operation between the squeeze roller 4 and the belt-shaped photosensitive body B, i.e., at the upstream side of the contact portion between the squeeze roller 4 and the belt-shaped photosensitive body B, as well as to clean the surface of the belt-shaped photosensitive body B.

Moreover, the wiper blade 11*a* is pushed by the moving mechanism 11*b* to the outer circumference of the squeeze roller 4 so as to remove the developing solution from the outer circumference of the squeeze roller 4.

The second squeeze roller 12 performs the same operation as when the moving frame 5 is at the upper stage, whereas the developing roller 2 and the cleaning roller 21 are lowered together with the moving frame 5 and set at a position apart from the belt-shaped photosensitive body B.

After this, the cam mechanism 6 is rotated again the direction of arrow "e" in the figure, the moving frame 5 is lowered from the intermediate stage (during a cleaning) to the lower stage, and rotation of the squeeze roller 4 and the second squeeze roller 12 stops. That is, as shown in FIG. 4, the radius r3 region of the cam plate 62 is brought into abutment with the abutment member 53 and the moving frame 5 is further apart from the belt-shaped photosensitive body B. Thus, the squeeze roller 4 is completely apart from the belt-shaped photosensitive body B and the squeeze support body 7 is supported only by the elastic force of the compression coil spring 8. Moreover, the wiper blade 11*a* is apart from the outer circumference of the squeeze roller 4. Finally, the belt-shaped photosensitive body B stops.

As has thus far been described, in the present embodiment, two compression coil springs 8 and 9 having different natural lengths are inserted between the moving frame 5 and the squeeze support body 7, so that it is possible to switch between one or two of the compression coil springs for applying an elastic force to the squeeze support body 7 according to the movement amount of the moving frame 5, thus enabling to obtain a nonlinear characteristic of the pushing force of the squeeze roller 4. Accordingly, it is possible to easily obtain different optimal pushing values for the squeeze operation and the cleaning operation by the squeeze roller 4, in comparison to a case employing only one compression coil spring.

To reduce the apparatus size, there is a need for reducing the length of the compression coil spring. This is realized by using two compression coil springs instead of one compression coil spring.

Since it is possible to obtain optimal depression force change, it is possible to obtain a preferable squeeze during a printing thereby to obtain a preferable image as well as to perform a preferable cleaning of the belt-shaped photosensitive body B immediately before stop of the apparatus. This can eliminate the adverse affect to the next printing without scratching the belt-shaped photosensitive body B.

In this embodiment, the longer compression coil spring 8 has a small spring constant and the shorter compression coil spring 9 has a large spring constant. This enables to obtain a large depression force change.

Here, the ratio between the depression force of the squeeze roller 4 obtained by the compression coil spring 8 alone and the depression force obtained by both of the compression coil springs 8 and 9 is set to 1:10. This is an optimal ratio as the depression force ratio between the squeeze operation and the cleaning operation. This enables to prevent an adverse affect to the next printing and prevent generation of scars on the photosensitive body, thus improving the printing environment.

Moreover, in the present embodiment, the developing roller 2 is mounted on the moving frame 5, so that the developing roller can move vertically to approach to and depart from the belt-shaped photosensitive body. For example, after a printing operation, the developing roller 2 can be departed from the belt-shaped photosensitive body B, thus preventing adhering of an unnecessary developing solution to the developing roller 2.

Furthermore, each of the developing roller 2 and the squeeze roller 4 is provided with a specific cleaning mechanism. Thus, it is possible to remove unnecessary developing solution from these rollers 2 and 4, enabling to maintain a clean surface of the belt-shaped photosensitive body B.

In addition, the second squeeze roller 12 is provided, which can effectively remove the unnecessary developing solution which has been left by the squeeze roller 4.

It should be noted that in the present embodiment, the belt-shaped photosensitive body is used. However, it is also possible to use a drum-shaped photosensitive body.

Description will now be directed to an image formation apparatus according to a second embodiment of the present invention. This image formation apparatus is a color image formation apparatus including four developing devices for the three primary colors of Yellow, Magenta, Cyan, and Black. In this color image formation apparatus, each of the developing devices has a corresponding squeeze roller which is brought into a depressing contact with a belt-shaped phtoosensitive body for removing a remaining ink adhered to a portion other than where a latent image has been formed on the belt-shaped photosensitive body. The squeeze roller depressing forces obtained by primary squeeze springs (PS springs) are set so as to increase in the order of Yellow, Magenta, Cyan, and Black, which is the developing order, so that the total of the depressing forces obtained by the four PS springs is set smaller than in a conventional apparatus.

Hereinafter, this second embodiment will be detailed with reference to the attached drawings.

Figure 5:
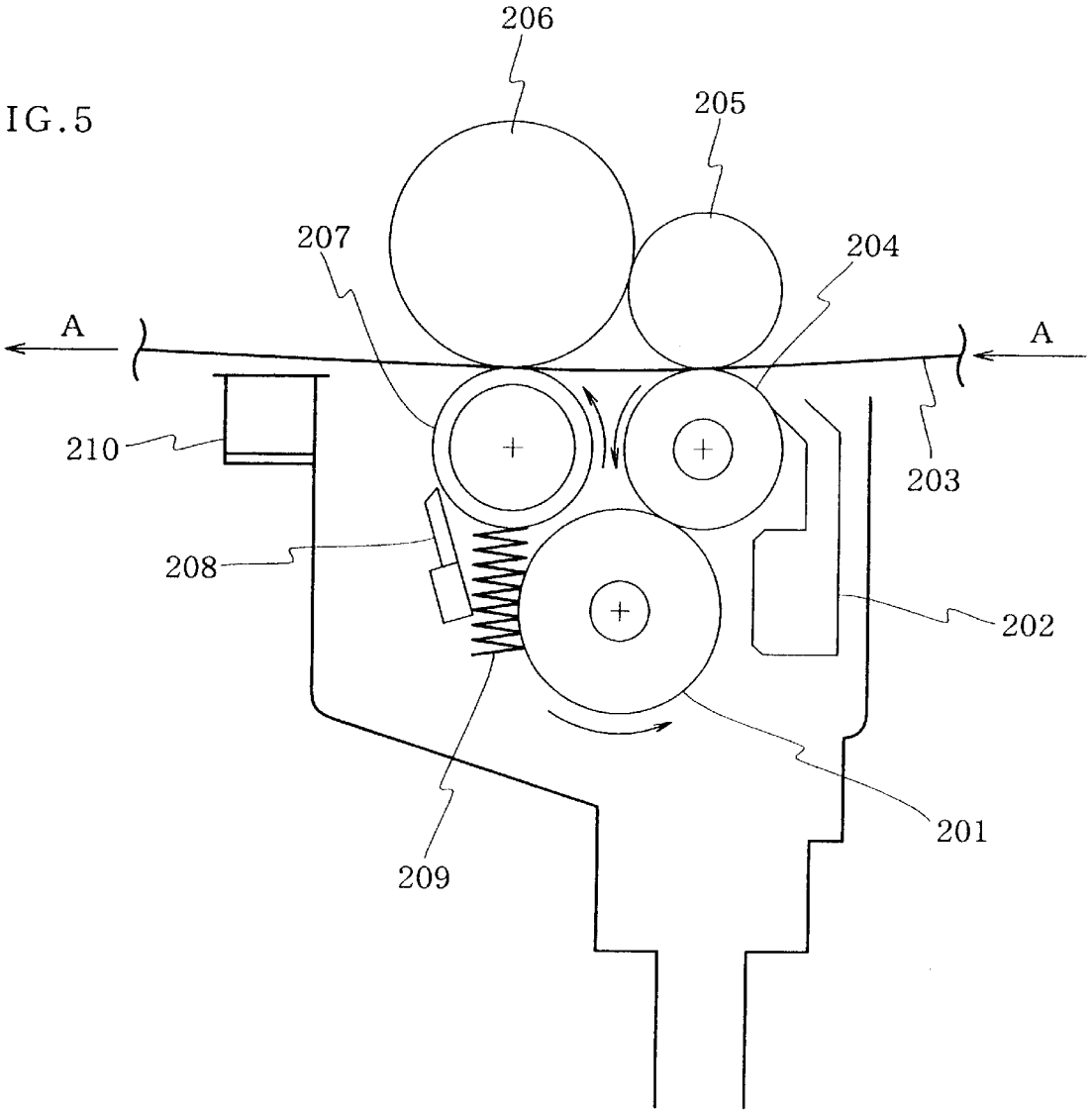
FIG. 5 is a cross sectional view of a developing device used in an image formation apparatus according to a second embodiment of the present inention.
Figure 6:
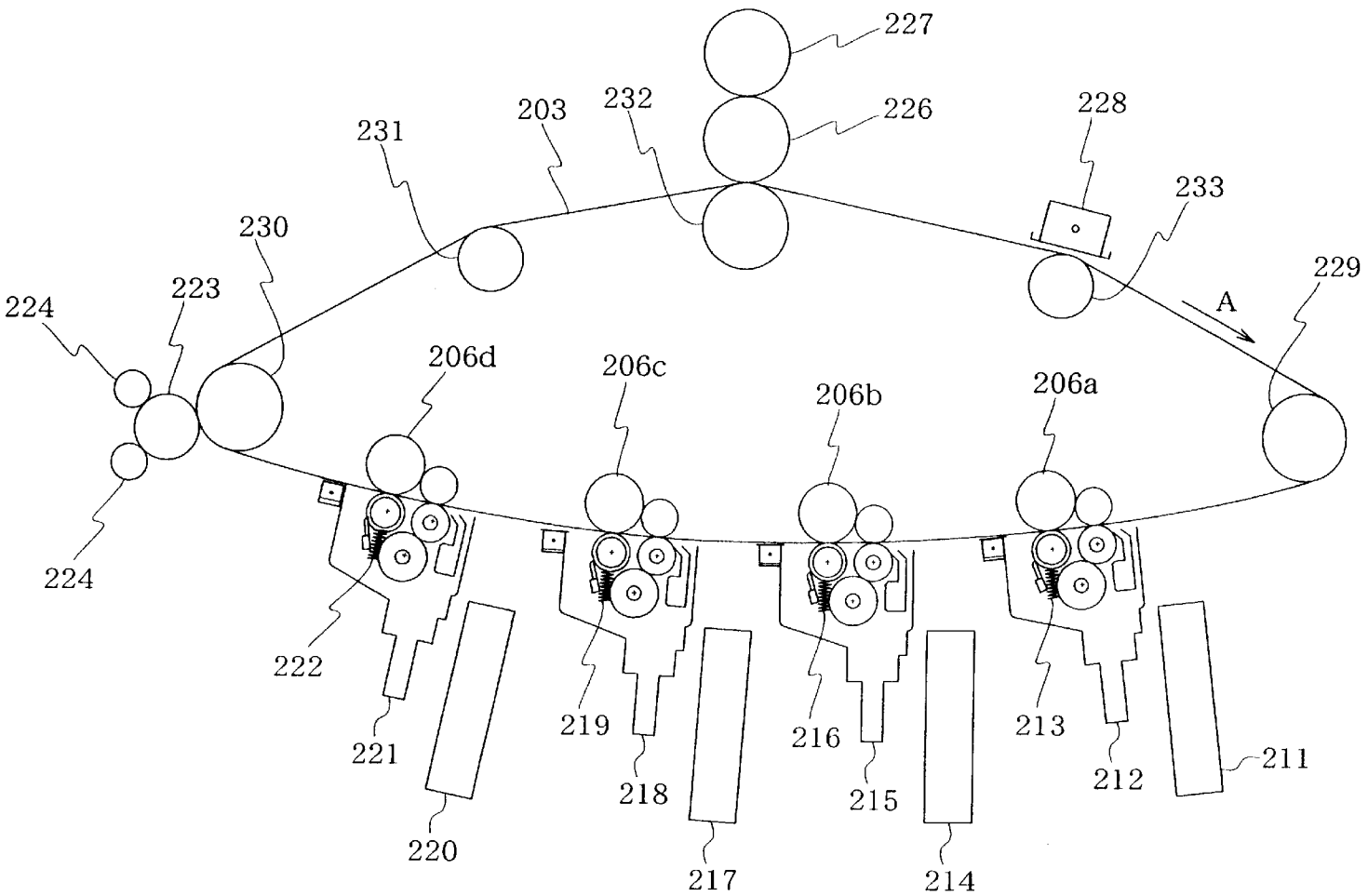
FIG. 6 is a front view of the image formation apparatus according to the second embodiment of the present invention.

FIG. 5 shows a detailed configuration of a developing device used in the color image formation apparatus according to the second embodiment shown as a side view in FIG. 6.

In FIG. 6, a belt-shaped photosensitive body 203 is set on a driver roller 229 and a follower roller 230. The belt-shaped photosensitive body 203 is driven by the drive roller 229 to circulate in the direction indicated by arrow A (clockwise). The belt-shaped photosensitive body 203 includes successively formed layers in the cross sectional direction: a photosensitive layer formed on an electro-conductive resin film, a barrier layer serving as a protection layer, and a release layer helping to separate a liquid toner (ink) from the belt-shaped photosensitive body.

Below the belt-shaped photosensitive body 203 traveling from the drive roller to the follower roller, there are provided a Yellow developer 212, a Magenta developer 215, a Cyan developer 218, and a Black developer 221 in this order in from right to left. Each of the developers has a corresponding laser device at its right: a Yellow laser device 211, a Magenta laser device 214, a Cyan laser device 217, and a Black laser device 220.

The belt-shaped photosensitive body 203 traveling from the follower roller 230 to the drive roller is guided by guide rollers 231, 232, and 233. A transfer roller 226 is arranged to face the guide roller 232 so as to sandwich the belt-shaped photosensitive body 203. Furthermore, a fixing roller 227 is arranged above the transfer roller 226. Moreover, a main charger 228 is provided at a position facing the guide roller 233.

A drying roller 223 is provided at a position facing the follower roller 230 so as to sandwich the belt-shaped photosensitive body 203. The drying roller 223 is in contact with two removal rollers 224, 224.

The belt-shaped photosensitive body 203 is uniformly charged by the main charger 228 and passing by the drive roller 229, reaches the position of the Yellow laser device 211, where a liquid yellow toner (yellow ink) is adhered and a laser beam is applied by an image signal for exposure. Subsequently, at the position of the Yellow developer 212, Yellow ink is applied to the portion where a latent image has been formed by the exposure, and development is performed.

The image on the belt-shaped photosensitive body 203 which has been developed by the Yellow ink is pushed against to a backup roller 206*a* by the yellow PS spring 213, so as to remove a yellow ink portion adhered to a portion other than the latent image and to dry the yellow ink image into a film state.

The depression force of the yellow PS spring 213 is set as follows. Since the Yellow ink is also depressed in the development procedure of the Magenta, Cyan, and Black, there is no need of making the yellow image into a complete film state. What is necessary is that the yellow ink is not mixed with the Magenta, Cyan, and Black inks. Thus, the depression force of the Yellow PS spring 213 is set to a low depression force of 3.9 kgf that assures that the Yellow image will not be deteriorated.

The Yellow developer 212, the Magenta developer 215, the Cyan developer 218, and the Black developer 221 have identical configuration except for the depression force of the respective PS springs, and identical operation except for the different ink colors. Hereinafter, an explanation will be given on the developer configuration and operation in general.

Referring back to FIG. 5, a developer includes a cleaning roller 201, a developing solution supply port 202, a developing roller 204, backup rollers 205 and 206, a squeeze roller 207, a blade 208, a PS spring 209 (the Yellow PS spring 213, the Magenta PS spring 216, the Cyan PS spring 219, and the Black PS spring 222 will be referred to as PS springs 209 in general), and a charger 210.

The developing roller 204 is made from a metal material. A liquid toner (ink) discharged from the developing solution supply port 202 is adhered to the surface of the developing roller 204 and supplied to the belt-shaped photosensitive body 203 for developing a latent image formed on the belt-shaped photosensitive body 203. There is a 0.15-mm gap between the developing roller 204 and the belt-shaped photosensitive body 203.

The cleaning roller 201 is made from a rough-foamed material and in contact with the developing roller 204 for cleaning the developing roller 204. The cleaning roller 201 is a hallow body having a hole in its shaft direction. The ink is supplied to this hole so as to ooze out from the foamed material for washing off the remaining ink from the developing roller 204.

The developing solution supply port 202 supplies ink to the developing roller 204 which has been cleaned by the cleaning roller 201.

The squeeze roller 207 is made from an elastic resin material such as urethane and serves to remove a toner remaining after the development on a portion other than the latent image on the belt-shaped photosensitive body 203, and to dry the developed image into a film state.

The backup roller 206 serves to sandwich the belt-shaped photosensitive body 203 together with the squeeze roller 207 with a pressure to make the image into a film state.

The blade 208 has a tip end which is not in contact with the squeeze roller 207 while the developer is performing developing but brought into contact with the squeeze roller 207 to remove remaining ink when the developer is departed from the belt-shaped photosensitive body upon completion of development.

The PS spring 209 pushes up the bearing portions at both ends of the squeeze roller 207 so as to maintain a constant depression force of the squeeze roller 207 to the belt-shaped photosensitive body 203 thereby to adjust the performance of the ink removal and the image film formation.

The charger 210 charges the belt-shaped photosensitive body 203 immediately after a development so as to successively perform development.

The developer having the aforementioned configuration operates as follows. That is, when the belt-shaped photosensitive body 203 having a latent image formed by radiation of a laser beam for a corresponding color image has reached the position of the developing roller 204 which is supplied with ink from the developing solution supply port 202, the developing roller 204 while rotating in the same direction as the belt-shaped photosensitive body 203, transfers the ink onto the latent image on the belt-shaped photosensitive body 203 for development. Here, the ink is adhered also to a portion other than the latent image and the developed image is in a wet state.

The belt-shaped photosensitive body 203 is further fed so that the developed image reaches the squeeze roller 207, where the ink adhered to a portion other than the image is removed by the squeeze roller 207 in pressed contact by the PS spring 209. Simultaneously with this, the developed image is dried into a film state.

After the development and film formation are complete, the photosensitive body 203 reaches the charger 210, where the photosensitive body 203 is uniformly charged to be fed to the next color.

Referring again to FIG. 6, explanation on the image formation apparatus will be continued.

Subsequently, the belt-shaped photosensitive body 203 reaches the Magenta laser device, where the Magenta ink is applied and a laser beam is applied by an image signal for exposure. After this, at the Magenta developer 205, the Magenta ink is applied to a latent image obtained by the exposure and development is performed. The Magenta ink adhered to a portion other than the image is removed with the depression force of the Magenta PS spring 206, and the Magenta ink image is made into a film state together with the Yellow ink image.

Here, the depression force of the Magenta PS spring 216 is set to 6.12 kgf which is higher than the depression force 3.9 kgf of the Yellow PS spring 213 and sufficient for preventing mixing of the Magenta ink with the Cyan and Black inks and deterioration of the Magenta image.

Furthermore, the belt-shaped photosensitive body 203 reaches the position of the Cyan laser device 217, where a laser beam is radiated for exposure by an image signal. Then, at the Cyan developer 218, Cyan ink is applied to a portion of a latent image formed by the exposure. The Cyan image is depressed by the force of the Cyan PS spring 219 so as remove a remaining Cyan ink from the portion other than the image. Simultaneously with this, the Cyan ink image is made into a film state together with the Yellow ink image and the Magenta ink image.

The depression force of the Cyan PS sprint 219 is 9.15 kgf which is higher than the depression force of the Magenta PS spring 216 and which is sufficient for preventing the Black ink from being mixed with the Magenta ink, and protecting the Yellow, Magenta, and Cyan images from deterioration.

Finally, the belt-shaped photosensitive body 203 reaches the Black laser device 220, where a laser beam is radiated by an image signal for development with a black ink and exposure is performed. Then, at the Black developer 221, the Black ink is applied for development, to the portion having a latent image formed by the exposure. The image is depressed by the force of the Black PS spring 222 to remove a remaining Black ink adhered to a portion other than the image as well as to make the Black ink image into a film state together with the Yellow ink image, the Magenta ink image, and the Cyan ink image.

The depression force of the Black PS sprint 222 is 12.18 kgf which is higher than the Cyan PS spring 219 and which is sufficient to obtain a complete film state because the Black ink development is the final stage of the development procedure.

Thus, the depression forces of the PS springs are in the relationship as follows:

$$\text{Yellow} < \text{Magenta} < \text{Cyan} < \text{Black}$$

The belt-shaped photosensitive body 203 carrying the image which has been developed by four developers reaches the drying roller 223, where the drying roller 223 further dries the developed inks so as to obtain a 98%-dried film. Moreover, the ink adhered to the drying roller 223 from the belt-shaped photosensitive body 203 is removed from the drying roller 223 by the removal roller 224. Thus, it is possible to prevent the drying roller 223 from performance deterioration due to absorption of the ink transferred from the belt-shaped photosensitive body 203.

The belt-shaped photosensitive body 203 then reaches the position of the transfer roller 226, where the image on the belt-shaped photosensitive body 203 is transferred onto paper (not depicted) fed between the transfer roller and the fixing roller 227. The image transferred is fixed to the paper by the fixing roller 227.

After this, the belt-shaped photosensitive body 203 again reaches the main charger 228 to repeat the aforementioned procedure.

In the aforementioned embodiment, the developers are arranged in the order of the Yellow, Magenta, Cyan, and Black. However, to obtain a color near to the natural color, it is possible to arrange the developers in the order of Magenta, Yellow, Cyan, and Black, or in the order of Cyan, Magenta, Yellow, and Black according to the ink characteristics.

Description will now be directed to an image formation apparatus according to a third embodiment of the present invention with reference to FIG. 7 to FIG. 10.

Figure 7:
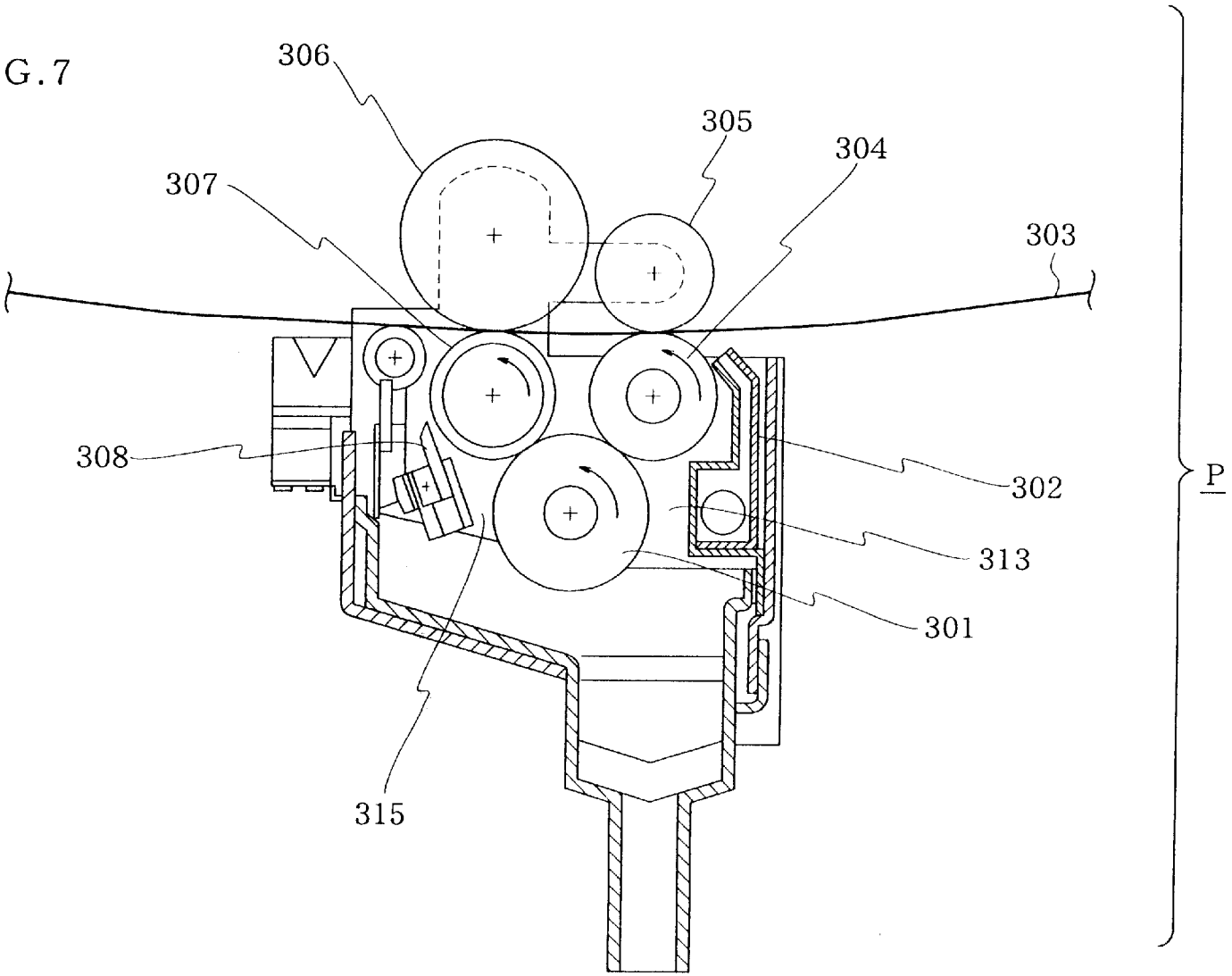
FIG. 7 is a cross sectional view of an image formation apparatus according to a third embodiment of the present invention.

FIG. 7 is a cross sectional view of the image formation apparatus P according to the third embodiment of the present invention. The image formation apparatus P includes a belt-shaped photosensitive body 303 and a developing roller 304 for supplying a developing solution onto the surface of this belt-shaped photosensitive body 303. The developing roller 304 is in contact with the belt-shaped photosensitive body 303. A first backup roller 305 is arranged to face the developing roller 304, so that the belt-shaped photosensitive body 303 is sandwiched by this first backup roller 305 and the developing roller 304. This assures supply of the developing solution from the developing roller 304 to the belt-shaped photosensitive body 303 as well as feed of the belt-shaped photosensitive body 303.

Moreover, the image formation apparatus P includes: rotation urging means (not depicted) for urging the rotation of the squeeze roller 307; a support unit 313 for supporting the developing roller 304 and a cleaning roller 301; and a cam mechanism (not depicted) for urging the movement of this support unit 313. Moreover, the image formation apparatus P includes a squeeze support unit 315 for holding the squeeze roller 304. The squeeze support unit 315 can approach and depart from the belt-shaped photosensitive body 303. Moreover, two types of compression coil springs (not depicted) having different natural lengths are inserted between the support unit 313 and the squeeze support unit 315.

The belt-shaped photosensitive body 303 is coated with a photosensitive material so that an electrostatic latent image can be formed by a light radiation. A light source is provided at the upstream side of this belt-shaped photosensitive body 303, so that a light is applied toward the belt-shaped photosensitive body 303 according to an image to be formed. This light source is generally a laser source. The belt-shaped photosensitive body 303 is electrically charged by a charger (not depicted) and when a light is applied, there arises a difference in potential between a region subjected to the light radiation and a region not subjected to the light radiation. It should be noted that the belt-shaped photosensitive body 303 has an endless loop.

In the vicinity of the developing roller 304, there is provided developing solution supply port 302. A developing solution is fed to this developing solution supply port 302 from a developing solution reservoir (not depicted) so as to supply the developing solution to the surface of the developing roller 304. More specifically, a predetermined pipe-shaped member is provided at the upstream side of the contact position between the developing roller 304 and the first backup roller 305. The developing solution is supplied from this pipe-shaped member to the developing roller 304.

Moreover, the squeeze roller 307 is arranged to be in contact with the belt-shaped photosensitive body 303 at the downstream side of the developing roller 304. A second backup roller 306 is provided to face the squeeze roller 307, so that the belt-shaped photosensitive body 303 is sandwiched by the squeeze roller 307 and the second backup roller 306. It should be noted that the belt-shaped photosensitive body 303 is fed in the direction indicated by an arrow in the figure has an electric latent image formed on its surface.

A blade 308 is provided in the vicinity of the squeeze roller 307. This blade 308 serves to remove a remaining developing solution from the surface of the squeeze roller 307. The squeeze roller has a surface made from an elastic rubber layer made from, for example, urethane, EPDM, or nitrile rubber.

Moreover, the cleaning roller 301 is arranged in the vicinity of the developing roller 304 and the squeeze roller 307. This cleaning roller 301 serves to remove a remaining developing solution from the developing roller 304 and the squeeze roller 307. This cleaning roller 301 is a member surrounded by an unwoven cloth such as cotton. However, the cleaning roller 301 may also be a foamed urethane roller, or a brush roller made from an acrylic, nylon, or rayon material.

Next, explanation will be given on operation and function of the image formation apparatus P having the aforementioned configuration.

The belt-shaped photosensitive body 303 has a region which has not been subjected to the light radiation, i.e., a non-image region at a potential of about 600V and an image region which has been subjected to the light radiation and at a potential of about 50 to 120 V. The developing solution containing a toner and a carrier mixed is supplied from the developing solution supply port 302 to the surface of the developing roller 304 rotating in the direction indicated by the arrow in the figure so that a liquid layer of the developing solution is formed on its surface.

The clearance between the developing roller 304 and the belt-shaped photosensitive body 303 is about 100 to 300 micrometers. The belt-shaped photosensitive body 303 is fed along the first backup roller 305 and the second backup roller 306. This enables the electrostatic latent image on the belt-shaped photosensitive body 303 to be developed by the developing solution on the developing roller 304.

On the belt-shaped photosensitive body 303, the toner image immediately after developed has a toner concentration of 20 to 50% with respect to the entire developing solution amount. As the belt-shaped photosensitive body 303 advances, an unnecessary portion of the developing solution is removed by the squeeze roller 307. Here, the squeeze roller 307 is in contact with the belt-shaped photosensitive body 303 with a pressure of about 1.2 kgf/cm2. This removes an unnecessary carrier and the toner remaining on the belt-shaped photosensitive body 303 has a toner concentration of about 50 to 80%. In this state, the toner is changed into a semi-solid state by its agglutination force and half-fixed on the belt-shaped photosensitive body 303.

As has been described above, the squeeze roller 307 has an elastic rubber layer of urethane, EPDM, or nitrile rubber. The rubber layer has a Shore hardness of 30 to 60 degrees and a contact pressure to the belt-shaped photosensitive body 303 is 200 to 500 gf/cm per unit length. However, these values are given here only as examples and may be changed according to the roller size and length.

With the aforementioned procedure, an appropriate toner image is formed on the surface of the belt-shaped photosensitive body 303. The belt-shaped photosensitive body 303 is further fed to a transfer block (not depicted), where the toner image is transferred onto a print paper. After the toner image is transferred, the belt-shaped photosensitive body 303 is again fed for the next image formation.

As has been described above, the developing roller 304 and the squeeze roller 307 is in direct contact with the developing solution. Accordingly, some portion of the developing solution is adhered to the surfaces of the developing roller 304 and the squeeze roller 307. For this, the surfaces are cleaned by the cleaning roller 301.

The cleaning roller is 301 a roller member surrounded by an unwoven cloth such as cotton fiber or a brush roller made from an urethane foamed material, acrylic, nylon, or rayon material. The cleaning roller 301 rotates keeping contact with the developing roller 4 so as to remove solidified toner by friction from the surface of the developing roller 304 and the squeeze roller 307.

Thus, in this third embodiment, the single cleaning roller 301 serves to simultaneously clean the developing roller 304 and the squeeze roller 307. That is, without increasing the necessary number of components, it is possible to effectively perform the cleaning operation compared to the case using the blade 308 alone for removing the developing solution.

Description will now be directed a modified example of the third embodiment.

In this modified example, the cleaning roller 301 is not in contact with the squeeze roller 307 during the development step. This is because the squeeze roller 307 is in contact with and rotated by the belt-shaped photosensitive body 303. If the rotation torque increases, the squeeze roller 307 cannot rotate with the same circumeferential speed as the belt-shaped photosensitive body 303, which results in breaking the toner image formed on the surface.

Figure 8:
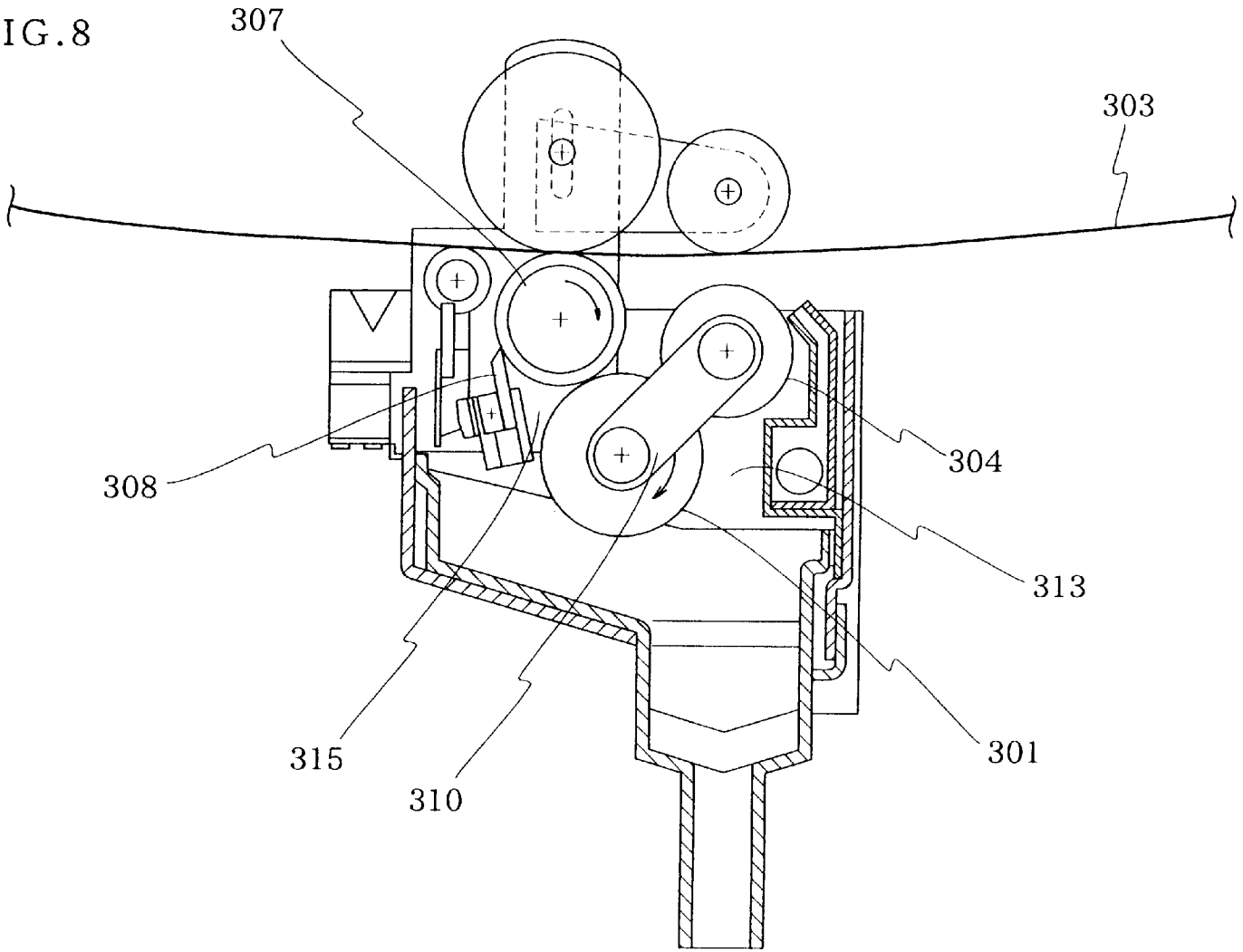
FIG. 8 is a cross sectional view showing a modification of the third embodiment with a developing roller in a state apart from a belt-shaped photosensitive body.

For this, cleaning of the squeeze roller 307 is performed after completion of the printing step. More specifically, the cleaning roller 307 is supported by a link structure 310 as shown in FIG. 8, so that the rotary shaft can be moved. That is, the cleaning roller 301 can move around the developing roller 304. It should be noted that the developing roller 304 and the cleaning roller 301 are supported by the support unit 313, so that they can simultaneously move vertically.

Moreover, the squeeze roller 307 and the blade 308 are supported by the same squeeze support unit 315 which can also be moved vertically. Accordingly, the support unit 313 which supports the developing roller 304 and the squeeze support unit 315 which supports the squeeze roller 307 and others can perform vertically movement separately from each other.

Figure 9:
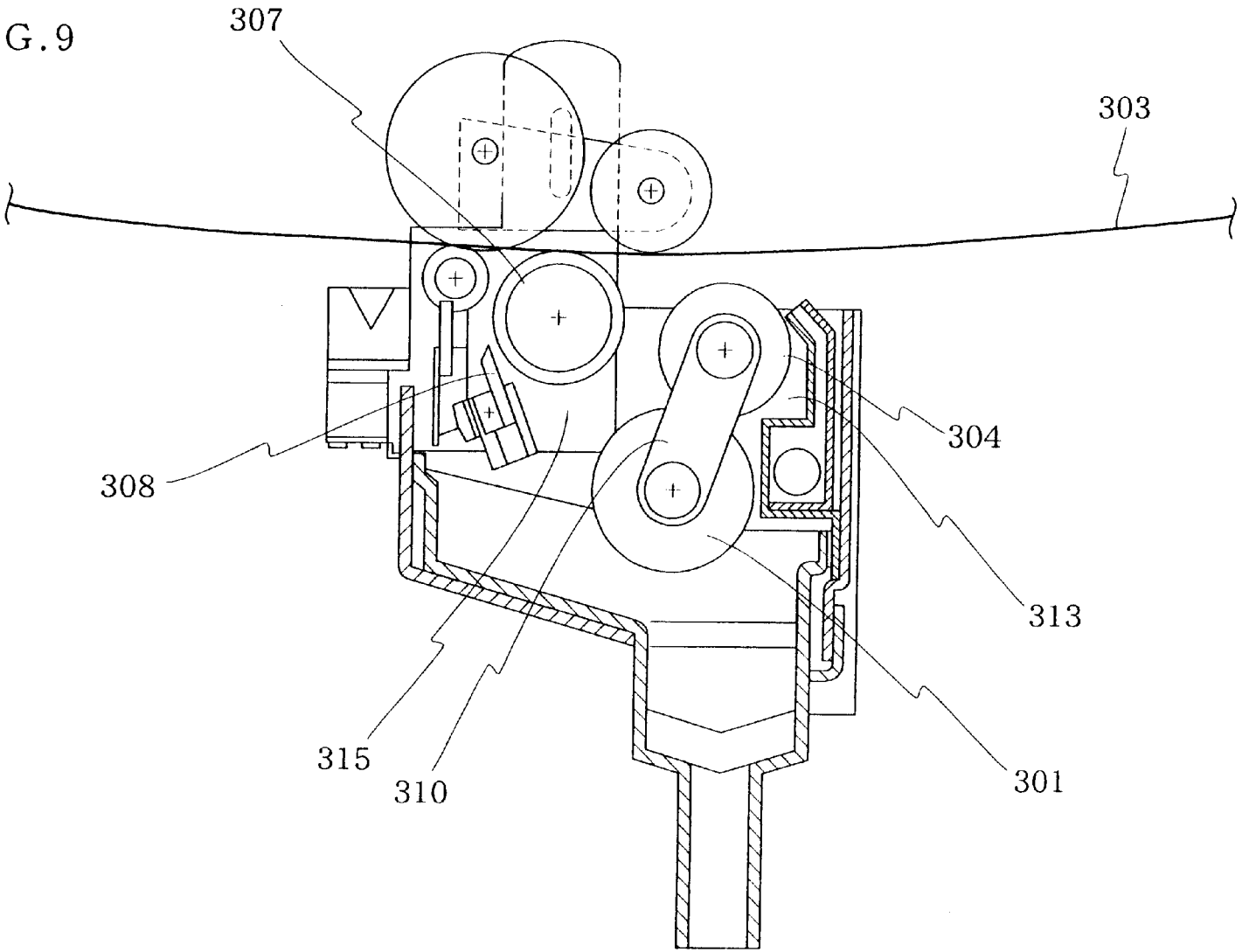
FIG. 9 is a cross sectional view of the apparatus shown in FIG. 8 with a squeeze roller in a state apart from the belt-shaped photosensitive body.
Figure 10:
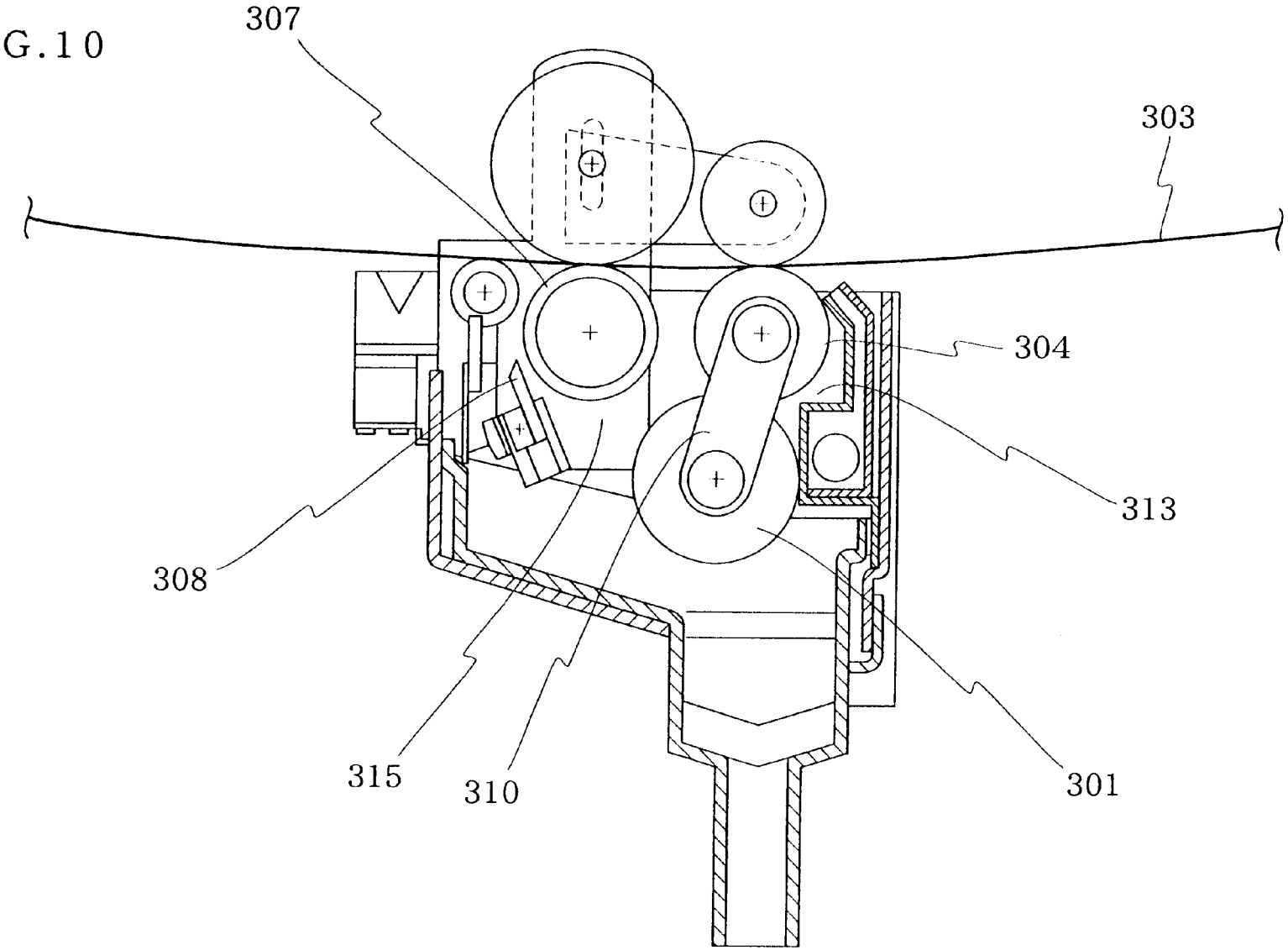
FIG. 10 is a cross sectional view of the apparatus shown in FIG. 8 with the developing roller and the squeeze roller in contact with the belt-shaped photosensitive body and a cleaning roller apart from the squeeze roller.

Here, operation upon completion of the printing step is shown in FIG. 8 to FIG. 10. FIG. 8 shows the developing roller 304 at a position recessed from the development position and apart from the belt-shaped photosensitive body 303. On the other hand, the squeeze roller 307 is in contact with the belt-shaped photosensitive body 303. This is because it is necessary to remove the developing solution remaining after the printing step on the belt-shaped photosensitive body 303. The squeeze roller 307 is rotated in the opposite direction to the feed direction of the belt-shaped photosensitive body 303 so as to remove the remaining developing solution.

While the squeeze roller 307 is removing the remaining developing solution from the surface of the belt-shaped photosensitive body 303, the squeeze roller 307 is in contact with the cleaning roller 301. Here, the squeeze roller 307 and the cleaning roller 301 rotate in the same direction (clockwise in FIG. 8). Accordingly, at the contact point between the squeeze roller 307 and the cleaning roller 301, the surface of the squeeze roller 307 and the surface of the cleaning roller 301 rotate in different directions. This effectively removes the developing solution from the surface of the squeeze roller 307.

Moreover, the aforementioned blade 8 is arranged in the vicinity of the squeeze roller 307. The blade 8 has a length almost identical to the entire length of the squeeze roller and removes the developing solution from the surface of the squeeze roller 307. The blade 8 has elasticity and can remove a solidified developing agent to a certain degree.

The cleaning roller 301 removes the developing solution from the squeeze roller 307 and is also in contact with the developing roller 304 to disperse again and remove the developing solution from the developing roller 304. The aforementioned procedure is performed within 0.5 to 1.5 seconds and the removal of the developing solution is complete.

After the removal of the developing solution is complete, as shown in FIG. 9, both of the developing roller 304 and the squeeze roller 307 depart from the belt-shaped photosensitive body 303. The system enters a wait state for the next printing instruction.

Moreover, FIG. 10 is a cross sectional view of the present embodiment during a normal printing operation. As shown in this FIG. 10, during a printing operation, the cleaning roller 301 is not in contact with the squeeze roller and in contact only with the surface of the developing roller 304. Thus, the cleaning roller 301 cleans the surface of the developing roller 304.

Description will now be directed to the effects of the present invention.

According to the present invention, two elastic members having different natural lengths are inserted between the moving frame and the squeeze support body, so that use of only one or two of the elastic bodies can be selected to apply an elastic force to the squeeze support body according to the moving amount of the moving frame. That is, it is possible to obtain a non-linear characteristic of the depression force of the squeeze roller. Accordingly, even if the depression force of the squeeze roller greatly changes between the squeeze operation and the cleaning operation, it is possible to easily obtain optimal values. This cannot be realized when using a single elastic body.

For the need of reduction in the apparatus size, the elastic body should also reduce its length. This can also easily be realized when using the two elastic bodies.

Because it is possible to obtain optimal values of the depression force, it is possible to obtain a preferable squeeze during a printing, enabling to obtain a preferable image as well as to perform a sufficient cleaning of the photosensitive body immediately before the apparatus stop. This eliminates a danger of deteriorating a following printing or scratching the photosensitive body.

With the aforementioned configuration, the elastic bodies may be compression coil springs having different lengths. The longer compression coil springs can have a spring constant set smaller than that of the shorter compression coil spring, thus enabling to obtain a large change of the depression force.

Here, by setting the ratio of the depression force of the squeeze roller obtained by use of only one of the compression coil springs and that obtained by simultaneous use of the two compression coil springs as 1:10, it is possible to obtain an optimal ratio of depression forces between the squeeze operation and the cleaning operation. This assures to prevent an adverse affect to the following printing or generation of scars on the photosensitive body, thus enabling to improve the printing environment.

Moreover, in the present invention, when the developing roller is mounted on the moving frame, it is possible to urge the vertical movement of the developing roller to/from the photosensitive body. For example, after a printing, the developing roller can depart from the photosensitive body, which prevents adhesion of an unnecessary developing solution.

Furthermore, a cleaning mechanism is provided for each of the developing roller and the squeeze roller. Thus, it is possible to remove an unnecessary portion of the developing solution from these rollers, enabling to maintain clean the surface of the photosensitive body.

Moreover, a second squeeze roller is provided, so as to effectively remove a remaining developing solution which has not been removed by the squeeze roller. This further clean the surface of the photosensitive body.

As has thus far been described, the present invention can provide an image formation apparatus having excellent characteristics which cannot be obtained by the conventional image formation apparatus.

The image formation apparatus according to the second embodiment of the present invention forms an Yellow image, a Magenta image, a Cyan image, and a Black image using corresponding developers in a predetermined order on a circulating belt-shaped photosensitive body. Each of the developers includes: a developing roller for supplying ink to a latent image formed on the belt-shaped photosensitive body by a corresponding laser device; a developing solution supply port for supplying ink to the developing roller; a squeeze roller provided at a downstream of the developing roller, for removing ink adhered to a portion other than the latent image on the belt-shaped photosensitive body and drying the developed image into a film state; a spring for depressing the squeeze roller to a backup roller provided on the opposite side to sandwich the belt-shaped photosensitive body; and a cleaning roller for cleaning the developing roller. The depression forces of the respective springs of the four color developers are set in the ascending order as the positional arrangement of the developers. This enables to reduce the total of the depression forces by the springs, which in turn reduces the load on the belt-shaped photosensitive body and the weight of frame of the color image formation apparatus. Moreover, the load reduction also results in a reduction in size of the motor driving the belt-shaped photosensitive body, enabling to obtain a color image formation apparatus of a small size and a light weight.

According to still another aspect of the present invention, a cleaning roller is provided to clean the surfaces of the developing roller and the squeeze roller by way of friction for re-dispersion of the developing solution adhered to the developing roller and the squeeze roller. This enables to maintain a high image quality for a long period of time.

Moreover, because the single cleaning roller can clean both of the developing roller and the squeeze roller, it is possible to effectively use the space in the image formation apparatus as well as to minimize the number of components required for cleaning.

Furthermore, the cleaning roller is in contact with the developing roller and rotates in the same direction as the developing roller. Accordingly, at the contact point between the cleaning roller and the developing roller, the rollers have a circumference speed in the opposite directions to each other. This enables to effectively remove a remaining developing solution from the surface of the developing roller.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 10-035047 (Filed on Feb. 17, 1998), Japanese Patent Application No. 10-035760 (Filed on Feb. 18, 1998), Japanese Patent Application No. 10-047382 (Filed on Feb. 27, 1998) including specification, claims, drawings and summary are incorporated herein by reference in its entirety.

What is claimed is:

1. An image formation apparatus for performing development by supplying to a photosensitive body a developing solution containing toner, said apparatus comprising:

a developing roller for carrying the developing solution to said photosensitive body;

a developing solution supply port for supplying the developing solution to said developing roller;

a squeeze roller for wiping off an unnecessary portion of the developing solution from said photosensitive body;

rotation urging means for urging rotary operation of said squeeze roller;

a moving frame reciprocally moving toward/from said photosensitive body;

a moving frame urging mechanism for urging movement of said moving frame;

a squeeze support body for holding said squeeze roller, said support body being mounted on said moving frame in such a manner that said support body can move toward/from said photosensitive body; and two elastic bodies having different natural lengths that are provided between said moving frame and said squeeze support body and can be expanded and contracted for urging depression of said squeeze roller toward said photosensitive body.

2. An image formation apparatus as claimed in claim 1, wherein said elastic bodies are compression coil springs arranged along the moving direction of said squeeze support body.

3. An image formation apparatus as claimed in claim 2, wherein said compression coil springs are a combination of a compression coil spring having a longer natural length and a smaller spring constant and a compression coil spring having a shorter natural length and a greater spring constant.

4. An image formation apparatus as claimed in claim 3, wherein said spring constants of said compression coil springs are set so that a depression force of said squeeze roller to said photosensitive body obtained by use of said compression coil spring having a longer natural length and a depression force of said squeeze roller to said photosensitive body obtained by simultaneous use of said two compression springs are in a ratio of 1:10.

5. An image formation apparatus as claimed in claim 1, wherein said developing roller is mounted on said moving frame.

6. An image formation apparatus as claimed in claim 1, said apparatus further comprising a cleaning mechanism for cleaning a surface of said squeeze roller.

7. An image formation apparatus as claimed in claim 1, said apparatus further comprising a second squeeze roller that is mounted on said squeeze support body at the downstream side of said squeeze roller relative to a direction of motion of the photosensitive body and that serves to wipe off any developing solution from the photosensitive body remaining outside both ends of said squeeze roller.

8. An image formation apparatus as claimed in claim 7, said apparatus further comprising a cleaning mechanism for cleaning a surface of said second squeeze roller.

9. A color image formation apparatus comprising a Yellow developer, a Magenta developer, a Cyan developer, and a Black developer for successively forming a Yellow image, a Magenta image, a Cyan image, and a Black image in a predetermined order on a circulating belt-shaped photosensitive body, each of said developers including:

a developing roller for supplying an ink to a latent image formed on said belt-shaped photosensitive body by a corresponding laser device;

a developing solution supply port for supplying the ink to said developing roller;

a squeeze roller provided at the downstream side of said developing roller relative to a direction of motion of the photosensitive body, so as to remove said ink adhered to a portion other than said latent image on said belt-shaped photosensitive body and to dry a developed image into a film state;

a backup roller provided so as to sandwich said belt-shaped photosensitive body between said backup roller and said squeeze roller;

a spring for depressing said squeeze roller to said backup roller; and a cleaning roller for cleaning said developing roller, wherein said springs in the different developers have different depression forces in ascending order from a first to a fourth developer.

10. A color image formation apparatus as claimed in claim 9, wherein said spring in the first developer is set to 3 to 9 kgf; said spring in the second developer is set to 6 to 12 kgf; said spring in the third developer is set to 9 to 15 kgf; and said spring in the fourth developer is set to 12 to 18 kgf.

11. A color image formation apparatus as claimed in claim 9, wherein said first developer is the Yellow developer, said second developer is the Magenta developer, said third developer is the Cyan developer, and said fourth developer is the Black developer.

12. A color image formation apparatus as claimed in claim 10, wherein said first developer is the Yellow developer, said second developer is the Magenta developer, said third developer is the Cyan developer, and said fourth developer is the Black developer.

13. A color image formation apparatus as claimed in claim 9, wherein said first developer is the Magenta developer, said second developer is the Yellow developer, said third developer is the Cyan developer, and said fourth developer is the Black developer.

14. A color image formation apparatus as claimed in claim 10, wherein said first developer is the Magenta developer, said second developer is the Yellow developer, said third developer is the Cyan developer, and said fourth developer is the Black developer.

15. A color image formation apparatus as claimed in claim 9, wherein said first developer is the Cyan developer, said second developer is the Magenta developer, said third developer is the Yellow developer, and said fourth developer is the Black developer.

16. A color image formation apparatus as claimed in claim 10, wherein said first developer is the Cyan developer, said second developer is the Magenta developer, said third developer is the Yellow developer, and said fourth developer is the Black developer.

17. A color image formation apparatus as claimed in claim 9, wherein said squeeze roller is made from an elastic resin material.

18. A color image formation apparatus as claimed in claim 17, wherein said squeeze roller is made from urethane.

* * * * *